United States Patent [19]

Horetzke

[11] Patent Number: 4,462,233

[45] Date of Patent: Jul. 31, 1984

[54] DETACHABLE GUARD FOR KEYHOLES

[76] Inventor: John R. Horetzke, 152 Baldwin Rd., Billerica, Mass. 01821

[21] Appl. No.: 371,523

[22] Filed: Apr. 26, 1982

[51] Int. Cl.[3] ..... E05B 17/14

[52] U.S. Cl. ..... 70/428; 70/14; 70/424

[58] Field of Search ..... 70/423, 424, 427, 428, 70/14, 19, 455, DIG. 57; 292/205; 211/192; 248/222.1, 551–553, 220.4, 225.4

[56] References Cited

U.S. PATENT DOCUMENTS

| | | | |
|---|---|---|---|
| 636,365 | 11/1899 | Stelzenmuller | 292/205 |
| 735,857 | 8/1903 | Carter | 292/205 X |
| 1,168,066 | 1/1916 | Girardot | 70/DIG. 57 |
| 1,411,824 | 4/1922 | Wepplo | 292/205 X |
| 2,717,140 | 9/1955 | Hulse, Jr. | 248/222.1 X |
| 3,211,408 | 10/1965 | Schaefer | 248/220.4 X |
| 3,334,501 | 8/1967 | Greenwald | 70/423 |
| 3,667,260 | 6/1972 | Foote | 70/14 X |
| 3,851,942 | 12/1974 | Clay et al. | 292/205 X |

*Primary Examiner*—Thomas J. Holko
*Assistant Examiner*—Thomas J. Dubnicka
*Attorney, Agent, or Firm*—Pearson & Pearson

[57] ABSTRACT

A detachable guard or cover for preventing access to the keyhole of cylinder type locks in the face of a wall or locked door of a tool cabinet is combined with openings in the wall on each side of said keyhole. The guard comprises a generally U-shaped body having a pair of anchor legs joined at one end by a shouldered rivet. The free terminal end of each leg has a right angular tongue which fits into one of the openings in the wall when the guard straddles the keyhole to anchor the guard against the rear face of the wall. A locking leg journalled on the rivet fixes the guard when in closed position. The anchor legs and the locking leg have holes, which register when in closed position, to receive the shackle of a padlock. Alternatively, a lock set or cylinder lock may be built in to the anchor legs, with its pawl positioned to immobilize the locking leg until turned by a key to unlock.

10 Claims, 11 Drawing Figures

DETACHABLE GUARD FOR KEYHOLES

BACKGROUND OF THE INVENTION

It has heretofore been proposed to restrict the access to cylindrical type locks in the walls of cabinets, etc. to prevent tampering with the lock and to prevent theft of the contents of the cabinet.

There have been a number of solutions for protecting the lock by means of a shroud, a keyhole guard, a keyhole stuffer and the like, as exemplified by the disclosures of the following patents.

In U.S. Pat. No. 1,457,702 to Hoff of June 5, 1923, a pair of spaced apart parallel bars with padlock with terminal locking dogs prevent access to the keyhole by filling the keyhole. This invention has the disadvantage of not fitting in small sized keyholes of cylinder type locks and can only fit if the keyhole is of sufficient size, rectilinear and unobstructed. It, therefore, does not have universal application.

In U.S. Pat. No. 1,206,611 to Strode of Nov. 28, 1916 a guard bar covers the keyhole to prevent access to the keyhole, and in U.S. Pat. No. 3,714,804 to French of Feb. 6, 1973 a shutter covers the keyhole. These inventions have the disadvantage of being difficult to install and each requires permanent bolt or rivet attachment to the cabinet so that they are not portable or detachable.

Other types of lock protectors are exemplified in U.S. Pat. No. 1,590,981 to Lockyer, U.S. Pat. No. 3,623,346 to Curtin or U.S. Pat. No. 3,874,204 to Capri wherein a shroud or cover fits over something which is spaced from the wall such as a lock handle or knob and is anchored by a part fitting under the same in the space. These devices would have no utility with the cylinder locks on tool cabinets or tool boxes because they have no projecting hooked parts and no handles or knobs to fit under for padlocking of a cover or shroud.

SUMMARY OF THE INVENTION

In this invention, the detachable guard is completely removable when unlocked, but restricts access to the keyhole of cylinder locks in the walls of sheet metal cabinets or the like. The wall of the cabinet supporting the cylinder lock is first provided with two drilled openings of predetermined size each on an opposite side of the lock. The guard consists of a generally U-shaped body formed by a pair of anchor legs joined by, and affixed on, a shouldered rivet. Each of the anchor legs has a free terminal end which has a cut out and a right angular tongue. The tongues fit into the openings to contact the rear face of the wall when the guard straddles the keyhole and the cutouts of the legs engage the front face of the wall.

An elongated locking leg is located between the anchor legs of the U-shaped body and is journalled on the shouldered rivet. The locking leg and each of the anchor legs each have a hole which when the guard is in locked position, register to receive the shackle of a padlock. Alternatively, a lock may be built into the guard.

DESCRIPTION OF THE PREFERRED EMBODIMENT

Figure 1:
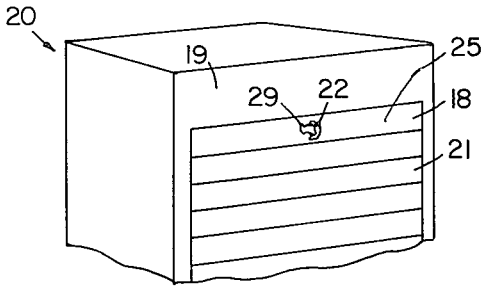
FIG. 1 is a fragmentary front perspective view of a typical lockable sheet metal tool cabinet with the guard of the invention affixed thereon.
Figure 2:
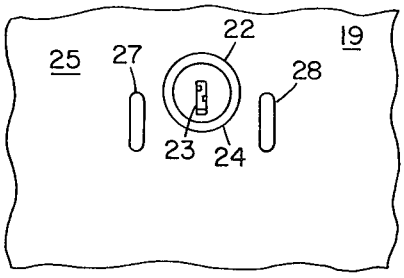
FIG. 2, is an enlarged fragmentary front view of the cylindrical key lock in the front face of the wall of a sheet metal tool cabinet with two openings formed therein.
Figure 3:
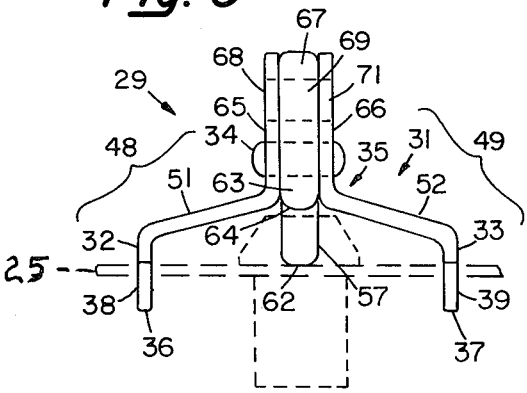
FIG. 3 is a top plan view of the guard in closed position.

The typical sheet metal, tool cabinet 20 shown in FIG. 1 is sometimes called a mechanic's tool chest and cabinet and is used by a mechanic to store tools and other valuables. The cabinet 20 has a plurality of drawers 21 and at least one drawer 18 has a cylinder lock 22. The cylinder lock 22 is usually of the pin-tumbler type and has a keyhole 23 in an annular, truncated conical escutcheon 24 which projects slightly from the chest.

The cylinder lock 22 prevents access to all drawers when locked and is affixed in a wall 25 which has a front face 19 and a rear face 26.

Unlike the complicated permanent, riveted or bolted anchor plates of the prior art, in this invention, anchoring is by merely drilling spaced apart openings 27 and 28 in the wall 25. Since the cabinet 20 is the tool cabinet of a mechanic, the drilling of the openings 27 and 28 as circular quarter inch openings, or preferably, forming the openings as vertical, narrow slots, is an easy task.

The guard 29 comprises a generally U-shaped body 31 consisting of a first anchor leg 32 and a second anchor leg 33. One end of each anchor leg is fast on a shouldered rivet 34 which connects the legs and forms the bight 35 of the U-shaped body. The other free terminal end 36 or 37 of each anchor leg has an elongated, right angular tongue 38 or 39 which is inserted into openings 27 or 28. The front faces 41 and 42 of each tongue 38 and 39 engage the rear face 26 of the wall 25 to secure the guard in place.

The tongue end of each anchor leg has a cut out at 44 or 45 with an upper rear face 46 or 47 which contacts and fits snugly against the front face 19 of wall 25.

Both of the anchor legs 32 and 33 have a central straddle portion 48 or 49 which is outwardly flared at 51 or 52 away from the rivet 34 to follow, and straddle, the contour of the projecting escutcheon 24 of the lock.

The central straddle portions 51 or 52 of each anchor leg are broad to prevent access to the cylinder lock from either side.

Figure 4:
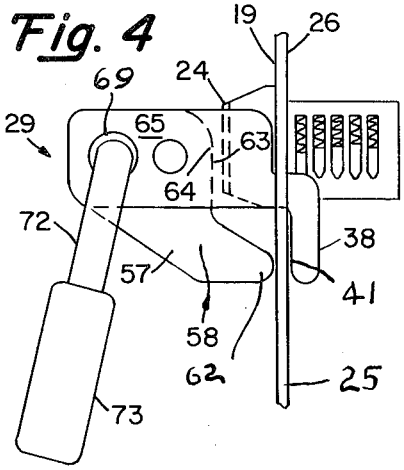
FIG. 4 is a side view thereof.
Figure 5:
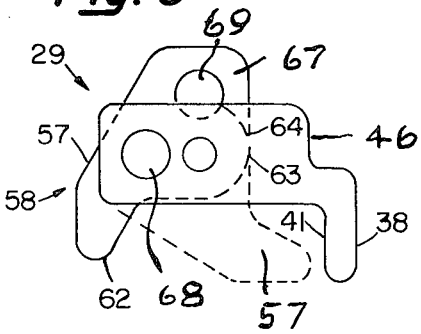
FIG. 5 is a side view of the guard in open position.
Figure 6:
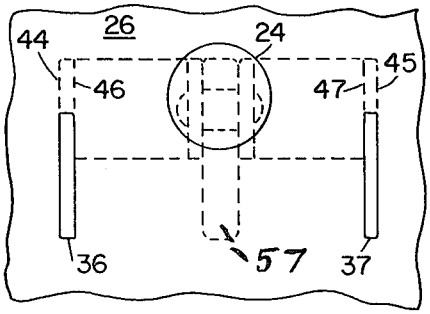
FIG. 6 is an enlarged fragmentary view of the rear face of the wall of the sheet metal tool cabinet with the guard inserted and in locking position.
Figure 7:
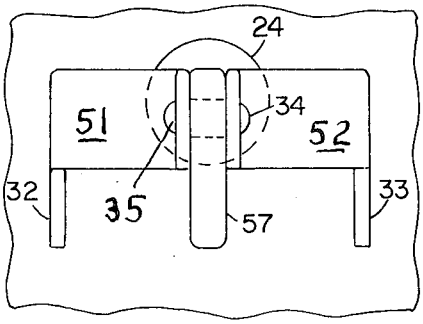
FIG. 7 is a rear view of the guard in closed position.
Figure 8:
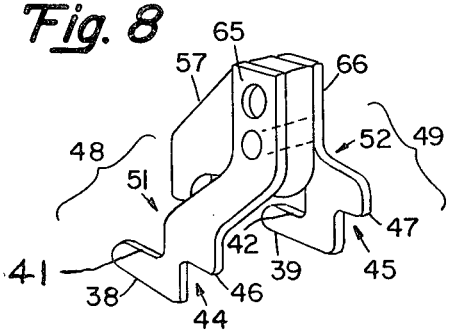
FIG. 8 is a perspective front view of the guard.

A locking leg, or pawl, 57 is journalled on the large diameter portion of the rivet 34. The leg 57 has an elongated shank 58 and is pivotable to move from an open position (FIG. 5) to a closed position (FIG. 4) so that the tip 62 engages the front face of the wall 25.

The rear face 63 of locking leg 57 is cut out at 64 to embrace and intimately contact the escutcheon 24 of the cylinder lock and cover the keyhole 23 to prevent access to the keyhole by lock picking tools, etc.

The bight sections 65 and 66 of the anchor legs and the corresponding section 67 of the locking leg are provided with padlock holes 68, 69, and 71, which register with each other when the guard is in closed position. The padlock holes when in register, receive the shackle 72 of a detachable padlock 73, thereby securing the guard 29 to the drawer 18 and preventing access to the lock 22 and the keyhole 23.

It will be seen that when the tripod-like completely detachable guard 29 is in closed and padlocked position over the cylinder lock 22, the wide straddle portions of the anchor legs prevent access to keyhole 23 from either side while the locking leg prevents access from top or bottom even to a hook shaped lock pick. When unlocked and bodily removed from the front wall of the tool cabinet, there are no projecting parts of the guard assembly on the cabinet and the guard folds into a compact closed tripod, easily stored in the pocket or elsewhere.

Figure 9:
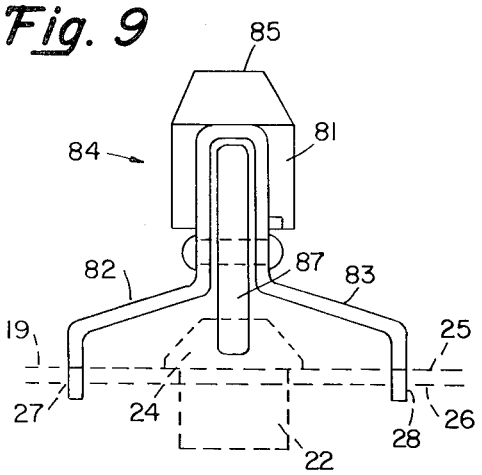
FIG. 9 is a plan view, FIG. 10 a front view and FIG. 11 a side view of another embodiment of the invention.
Figure 10:
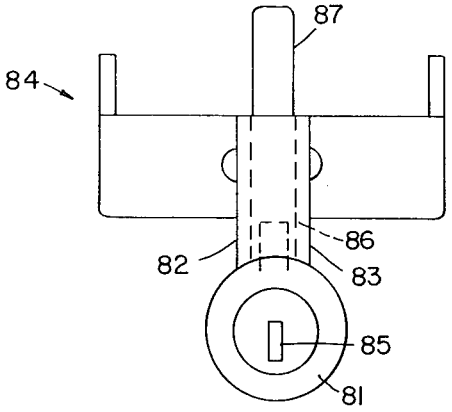
Figure 11:
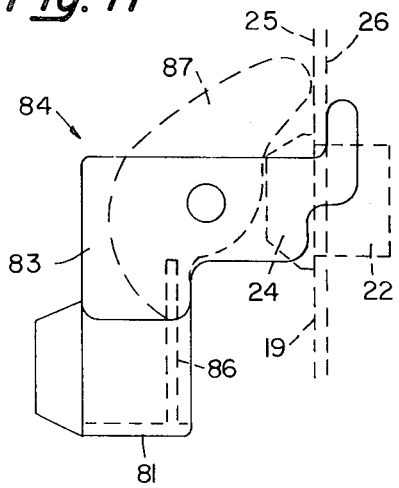

As shown in FIGS. 9, 10, and 11, in another embodiment, a cylindrical lock set 81 may be welded to the anchor legs 82 and 83 of a guard 84, with a key hole 85 for a separate key, and with its pivotable pawl 86 normally affixing the locking leg 87 in locked position. When lock set 81 is unlocked, pawl 86 pivots out of the path of leg 87 to permit the leg to pivot relative to the anchor legs 82 and 83 and release the guard 84.

I claim:

1. A detachable guard for preventing access to the keyhole of cylinder type locks in a wall of a locked drawer or the like:

said wall having a front face and a rear face;

the front face of the said wall having a pair of spaced apart openings of pre-determined size, each on an opposite side of the cylinder lock;

said guard comprising a generally U-shaped body having a pair of anchor legs which are joined at one end on a rivet;

said legs being adapted to straddle the keyhole of said cylinder type lock;

each of said anchor legs having a free terminal end with an integral tongue extending at right angles thereto and each adapted to be received in one of said openings to contact the rear face of said wall;

a locking leg journalled on said rivet between said pair of anchor legs, and having a free terminal tip;

said locking leg being pivotable from an open position, releasing said anchor tongues from said openings to a closed position with said tip contacting the front face of said wall and locking said tongues in said openings;

said pair of anchor legs and said locking leg each having holes, which register with each other, when said legs are in locking position to receive the shackle of a padlock.

2. A detachable guard, as specified in claim 1 wherein:

the openings in said wall are each elongated narrow parallel slots.

3. A detachable guard assembly for preventing entrance to the keyhole of a lock in the wall of a tool cabinet characterized by:

said wall having a pair of elongated openings each on an opposite side of the keyhole of said lock;

a generally U-shaped body formed by a pair of anchor legs each fast on a shouldered rivet proximate one end of each leg;

the other end of each anchor leg of said U-shaped body being a free terminal end having a tongue at right angles to the leg;

said tongues fitting closely into said elongated openings and engaging the rear face of said wall and securing the tongues of the anchor legs there against;

said tongues having an upper portion cut out to engage the front face of said wall;

a locking leg or pawl, journalled on said shouldered rivet proximate one end;

said locking leg having a tip at the other end engaging the front face of the wall when in closed position;

the locking leg having a cut out engaging the keyhole of the lock when in said closed position;

said anchor legs and said locking leg having padlock holes which register when said locking leg is in closed position to receive the shackle of a padlock.

4. A guard for preventing access to the keyhole of a cylinder lock in a wall of a metal tool cabinet, or the like, said device characterized by:

said wall having a pair of elongated, spaced parallel slot like openings therethrough, each on an opposite side of the keyhole of said lock;

and a bodily removable, detachable cuff having a generally U-shaped body, adapted to straddle the keyhole of said cylinder lock, and formed by a pair of anchor legs, each having a central portion joined to the central portion of the other by, and affixed on, a shouldered rivet, each having an elongated outwardly flared portion, on one side of said rivet, terminating in a right angular cut out and a right angular tongue and each having a portion on the other side of said rivet with a padlock hole therein;

said guard having a locking leg with a central portion pivotable on said shouldered rivet to swing between said anchor legs, said locking leg having an elongated shank on one side of said rivet terminating in a free terminal tip and a portion on the other side of said rivet with a padlock hole therein;

the tongues of said anchor legs being in parallelism and insertable in said slot-like openings in said wall and said locking leg being pivotable to engage said tip against said wall to anchor said guard in straddle, tripod position, over said keyhole and said padlock holes being then in register to receive the shackle of a padlock.

5. A guard for preventing access to the keyhole in the projecting, annular escutcheon of a cylinder lock in a wall of a tool cabinet, said device comprising:

a generally U-shaped body formed of a pair of anchor legs, joined by, and fast on, a shouldered rivet forming the bight of the U;

each anchor leg having a free terminal end with a cut out to engage the front face of said wall and a right angular, integral tongue to engage the rear face of said wall;

and a locking leg journalled on said shouldered rivet to swing between said anchor legs, said locking leg having a free terminal tip to engage the front face of said wall;

said anchor legs being adapted to be inserted in slot like openings, in the wall of said cabinet to straddle said keyhole; and said anchor legs and locking leg having holes therein which register to receive the shackle of a padlock when said anchor leg tongues are inserted in said slot like openings in said wall and said locking tongue is moved to lock position.

6. A guard as specified in claim 5 wherein:

said locking leg includes a cut out in the front thereof to receive said projecting, annular escutcheon of a typical cylinder lock, the front face of said leg at said cut out being shaped and dimensioned to engage and cover said keyhole, when said guard is in locked position.

7. A guard as specified in claim 5 wherein:

each said anchor leg is in parallelism with the other at said shouldered rivet and thence flares outwardly away from the other to enable said body to straddle the keyhole portion of said cylinder lock and then terminates in said tongue portion said tongue portions being in parallelism with with each other.

8. A detachable guard for preventing access to the keyhole of cylinder type locks in a wall of a locked drawer or the like:

said wall having a front face and a rear face;

the front face of the said wall having a pair of spaced apart openings of pre-determined size, each on an opposite side of the cylinder lock;

said guard comprising a generally U-shaped body having a pair of anchor legs which are joined at one end on a rivet;

said legs being adapted to straddle the keyhole of said cylinder type lock;

each of said anchor legs having a free terminal end with an integral tongue extending at right angles thereto and each adapted to be received in one of said openings to contact the rear face of said wall;

a locking leg journalled on said rivet between said pair of anchor legs, and having a free terminal tip;

said locking leg being pivotable from an open position, releasing said anchor tongues from said openings to a closed position with said tip contacting the front face of said wall and locking said tongues in said openings;

and separate lock means, for immobilizing said locking leg relative to said anchor legs, until unlocked.

9. A detachable guard as specified in claim 8 wherein:

said separate lock means includes registering holes in said anchor legs and said locking leg, and a conventional padlock having its shackle in said holes.

10. A detachable guard as specified in claim 8 wherein:

said separate lock means includes a cylindrical lock set affixed to said anchor legs and having its pivotable pawl in the path of said locking leg, but movable out of said path by unlocking said cylindrical lock set.

* * * * *